US005660755A

United States Patent [19]

Michaluk, III

[11] Patent Number: 5,660,755

[45] Date of Patent: Aug. 26, 1997

[54] MICROWAVE OVEN WITH BUILT-IN FOOD COVERING MECHANISM

[76] Inventor: Mitchell Michaluk, III, 17501 Mulvaney, Manchester, Mich. 48158

[21] Appl. No.: 599,678

[22] Filed: Feb. 12, 1996

Related U.S. Application Data

[63] Continuation-in-part of Ser. No. 262,922, Jun. 20, 1994, Pat. No. 5,550,356.

[51] Int. Cl.[6] ..... H05B 6/80

[52] U.S. Cl. ..... 219/734; 219/702; 219/756; 219/403; 99/DIG. 14; 126/220; 126/340

[58] Field of Search ..... 219/734, 729, 219/685, 736, 745, 756, 757, 752, 405, 403, 404, 762, 702; 99/DIG. 14; 126/340, 220, 211, 217, 218, 237 R

[56] References Cited

U.S. PATENT DOCUMENTS

| | | | |
|---|---|---|---|
| 2,956,144 | 10/1960 | Woodman | 219/746 |
| 3,275,799 | 9/1966 | Meltzer | 219/404 |
| 3,281,575 | 10/1966 | Ferguson, Jr. | 219/404 |
| 3,854,021 | 12/1974 | Moore et al. | 219/734 |
| 3,980,856 | 9/1976 | Allen et al. . | |
| 4,303,819 | 12/1981 | Kaufman, Jr. et al. | 219/762 |
| 4,456,164 | 6/1984 | Foster et al. . | |
| 4,488,025 | 12/1984 | Tanabe | 219/685 |
| 4,503,307 | 3/1985 | Campbell et al. . | |
| 4,596,914 | 6/1986 | Morino | 219/685 |
| 4,629,850 | 12/1986 | Tanabe | 219/685 |
| 4,762,973 | 8/1988 | Schultz | 219/746 |
| 4,871,892 | 10/1989 | Samford | 219/734 |
| 4,892,213 | 1/1990 | Mason, Jr. . | |
| 4,925,765 | 5/1990 | Madeleine . | |
| 4,980,529 | 12/1990 | Bolton | 219/752 |
| 5,028,754 | 7/1991 | Chiba | 219/735 |
| 5,126,520 | 6/1992 | Nottingham et al. . | |
| 5,241,150 | 8/1993 | Garvey et al. . | |
| 5,550,356 | 8/1996 | Tripp et al. | 219/734 |

FOREIGN PATENT DOCUMENTS

| | | | |
|---|---|---|---|
| 52-74941 | 6/1977 | Japan | 219/734 |

*Primary Examiner*—Philip H. Leung

*Attorney, Agent, or Firm*—Gifford, Krass, Groh, Sprinkle, Patmore, Anderson & Citkowski, P.C.

[57] ABSTRACT

A microwave oven with built-in food covering mechanism, the microwave having a body defined by a top, bottom, sides and rear. A door is hingedly connected to the body and is opened to reveal an open interior of the body. A covering member is suspended within the oven interior by a length of cord which extends through the top of the oven and is connected to an electric motor built into the microwave body. The motor includes a rotating gear head which rotates in one of two directions to either wind or unwind the cord to either elevate or lower the covering member within the interior. A microprocessor energizes and deenergizes the motor and is operated by either a key entry and a program memory or by a lever arm switch and limit switch assembly within the microwave interior.

11 Claims, 3 Drawing Sheets

MICROWAVE OVEN WITH BUILT-IN FOOD COVERING MECHANISM

CROSS REFERENCE TO RELATED APPLICATIONS

The present application is a continuation-in-part of U.S. Ser. No. 08/262,922, filed Jun. 20, 1994, U.S. Pat. No. 5,550,356 for A Food Covering Device For Use With A Microwave Oven.

BACKGROUND OF THE INVENTION

1. Field of the Invention

The present invention relates generally to food covering devices and, more specifically, to a microwave oven with a built-in food covering mechanism which is upwardly and downwardly movable in either an automatic or a manually controlled fashion for selectively covering or-uncovering an item placed within the microwave interior.

2. Description of the Prior Art

Covering devices of various types and designs are known in the art for covering a food item placed within a microwave during the heating stage. Such covering devices are advantageously used within the microwave oven for preventing the food item being heated from splattering during the microwaving process.

Pending application U.S. Ser. No. 08/262,922, upon which the present application claims priority in part, teaches a food covering device for use with a microwave in which a food covering member is suspended from a ceiling of the microwave interior by a cord. The cord attaches to the covering member at one end and to a door of the microwave at the other end. An adjustment guide is mounted to a wall of the oven and receives an intermediate portion of the cord in order to adjust the extent of the raising and lowering of the covering member upon the opening and closing of the door.

Japanese Reference No. 52-7491 teaches a high frequency heating device incorporated into a microwave oven which includes a lid member pivotable in an angular fashion about an edge by an arm, the arm having an intermediate joint and connecting to a door to separate the lid member from the food when the door is opened. A heater is fitted within the lid member to create scorch patterns in the food.

U.S. Pat. No. 3,854,021, issued to Moore et al., teaches a conductive shield device which is mounted within an electromagnetic heating system and which is similarly pivotable in an angular fashion about an edge. The device is specifically designed for use in a high-volume institutional setting such as a cafeteria to shield cold portions of a meal tray during microwaving. The shield is actuated between a covered and an upwardly tilted position by a lever and spring arrangement extending from the oven door to cover the cold portions of the meal prior to actuating the microwave device.

While such devices provide an effective means for covering or shielding a food item within a microwave enclosure, they tend to be very unwieldy and cumbersome in operation and are for the most part unsuitable for use with more modern microwave devices. The prior art devices are further ill-suited for use as a convenient cover which is easily displaceable over a food item placed within a microwave enclosure and which permits the microwaves to reach the food while preventing the food from splattering the interior walls of the microwave enclosure.

SUMMARY OF THE PRESENT INVENTION

The present invention is a microwave oven with a built-in food covering mechanism. The oven has a body with an open interior which is defined by a top, a bottom and a plurality of sides. A door is hingedly attached to the microwave body is capable of being opened and closed to reveal the open interior. A covering member is suspended by a length of cord from the top of the microwave interior.

Actuating means are provided for selectively elevating and lowering the covering member and include an opposing end of the cord which is wrapped around a rotating gear head portion of an electric motor built into the microwave body. The actuating means further includes a microprocessor which is in communication with the electric motor and activates and deactivates the motor to raise and lower the cover. A key entry display is provided on a front face of the microwave and communicates with the microprocessor to visually display settings which correspond to the commands issued by the microprocessor and to issue commands to the microprocessor. A program memory is also in communication with the microprocessor and is capable of storing to memory key entered cover settings.

The cover member is elevated and lowered according to a first preferred embodiment based upon preset operating parameters loaded into the program memory. A lever and switch assembly may also be incorporated into the suspending means and communicates with the microprocessor to activate and deactivate the motor. According to the further preferred embodiment, relaxed tension on the cord which is indicative of the cover member reaching the bottom of the microwave results in the lever assembly rotating to open a circuit to the microprocessor to shut off the motor. A limit switch assembly is positioned on the top of the microwave interior in proximity to the suspending means and is tripped by the cover reaching a certain height to shut off the motor. In this fashion, the lid is raised and lowered to cover the food item placed in the microwave enclosure without the necessity of placing any type of covering or wrap over the item during heating.

BRIEF DESCRIPTION OF THE DRAWINGS

Reference will now be had to the attached drawings, when read in combination with the following specification, wherein like reference numerals refer to like parts throughout the several views, and in which.

DESCRIPTION OF THE PREFERRED EMBODIMENTS

Figure 1:
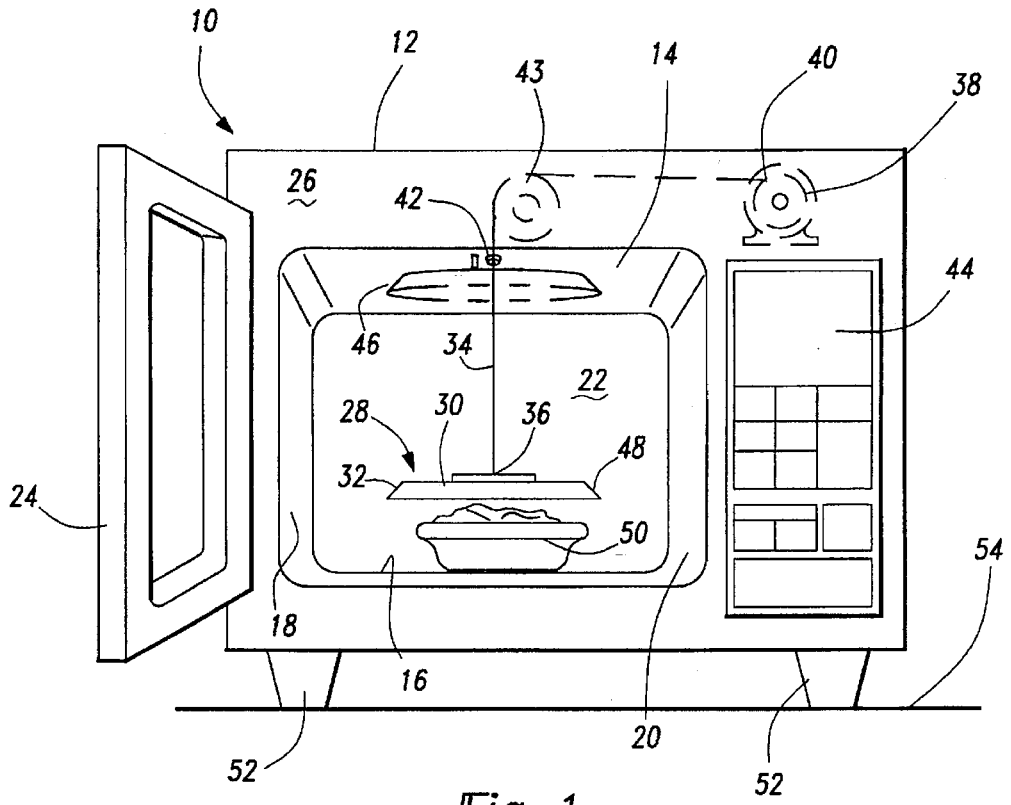
FIG. 1 is a view of the microwave oven with built-in food covering mechanism according to the present invention.

Referring to FIG. 1, a microwave oven with built-in food covering mechanism 10 is shown according to the present invention. A microwave oven has a body 12 which is of a type and design consistent with conventional models and is constructed of a top 14, a bottom 16, a first side 18, a second side 20 and a rear side 22 which in combination defines an open interior. A door 24 is hingedly attached to a front face 26 of the body 12 in proximity to the first side 18 and is pivotable about the connection to selectively open and close the door to reveal the open interior. The open interior is consistent with that of most conventional microwave ovens and is defined by a substantially rectangular or square shape. However, the interior may adopt any other desired shape.

A cover member 28 is positioned within the microwave open interior and, according to a preferred embodiment, includes a generally planar body portion 30 which is rimmed by an angled side portion 32. The cover member 28 is preferably circular in cross section with the side portion 32 ringing the circumference of the body portion 30, however the cover member can form any desired shape which is capable of being fit within the open interior. A suspending means selectively elevates and lowers the cover member 30. The suspending means is preferably provided by a length of cord 34, a first end of which attached to a top central portion of the cover member 28, at 36, and a second end of which is attached to an electric gear motor 38, at 40. The cord 34 extends through an opening 42 positioned centrally within the oven top 14 and the electric motor 38 is mounted within the microwave body 12 at a position away from the open interior. An intermediate pulley-type member 43 may be rotatably mounted above the opening 42 between the cover member 28 and the motor 38 for supporting the cord 34. Alternatively any other type of support or appropriately configured surface can be employed as a positioning and support guide for the cord 34. A more thorough explanation of the function of the motor 38 will be had upon reference to the feature described in FIG. 2.

A key entry means 44 is provided on the front face 26 of the oven 12 on the side of the open interior and is in electrical communication with the motor 38 for actuating the cover member 30 from a position 46 indicated in phantom in which the cover 30 is positioned proximate the top 14 of the interior enclosure to a position 48 in which the cover 30 is lowered and positioned overhead a food item 50 which is set upon the bottom 16. Finally, a plurality of set-offs 52 support the microwave body 12 in an upwardly spaced manner upon a flat surface 54.

Figure 2:
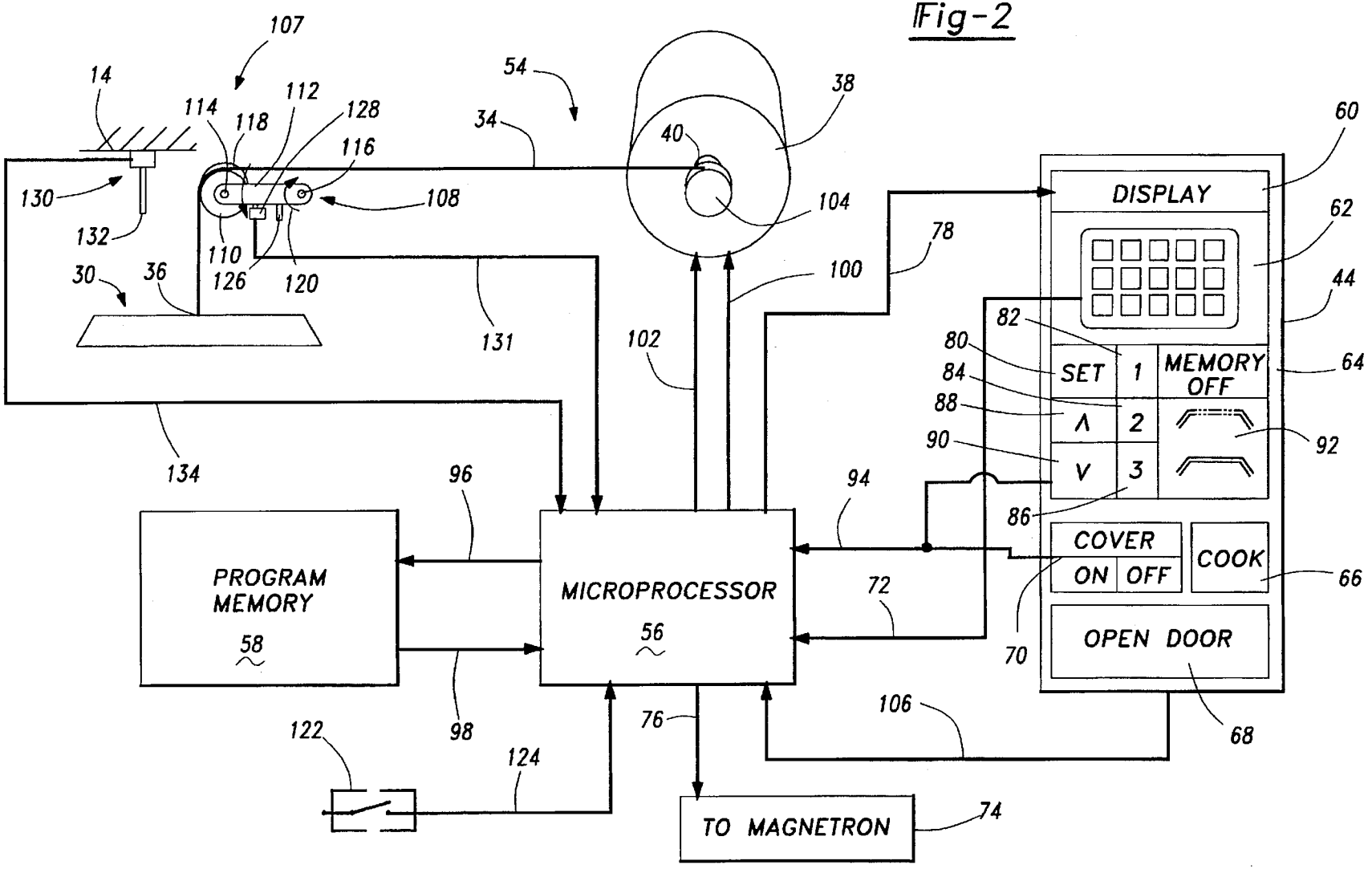
FIG. 2 is a control diagram showing the arrangement of elements comprising the cover member actuation means according to the preferred embodiment of the present invention.

Referring now to FIG. 2, a control diagram 54 illustrates the actuation means for elevating and lowering the covering member 30 either automatically or in a controlled fashion. The key entry 44 identified in FIG. 1 is in electrical communication with a microprocessor 56 which is also built into the circuitry of the microwave body 12. Also in communication with the microprocessor 56 and working in combination with the key entry means 44 is a program memory 58. The program memory 58 is capable of storing operating parameters inputted into the key entry means 44 for retrieval by the microprocessor as will now be discussed.

The key entry means 44 according to the preferred embodiment is primarily separated into three major portions, a visual display portion 60, a conventional microwave keyboard entry portion 62 and a cover member program memory portion 64. The key entry means 44 may also include such conventional microwave features as a cook button 66 and an open door button 68. A separate on/off cover command button 70 is also provided on the key entry 4 for directly activating and deactivating the cover member 30.

Referring again to FIG. 2, a user of the microwave can key enter typical command functions relating to heat time and defrost cycles by utilizing the command buttons in the entry portion 62. The commands entered into the key portion 62 are electrically issued to the microprocessor 56 through a line 72 extending between the key portion 62 and the microprocessor 56. The commands entered through the key portion 62 are processed by the microprocessor 56 which then issues the appropriate commands to a magnetron 74 through a line 76 extending therebetween. The magnetron 74 generates the microwaves for heating the food item placed within the open interior as is shown in FIG. 1 and is of a conventional type and design. A line 78 connects the microprocessor 56 to the visual display portion 60 of the key entry 44 and displays such visual data as remaining heating time, defrost or regular cook cycle, and the like.

The microprocessor 56 commands discussed above are those typically associated with a conventionally operating microwave oven without a cover mechanism according to the present invention. Referring again to FIG. 2, the program memory portion 64 of the key entry 44 provides a user with the ability to program one or more lower and lift cycles of the cover member 30 or to directly actuate the cover member upwards and downwards. A set button 80 is depressed to enable the user to enter either a first program setting 82, a second program setting 84, or a third program setting 86. An upward directional button 88 and a downward directional button 90 are separately actuable to either manually raise or lower the cover member 30 or are utilized in combination with the set button 80 and program setting buttons 82, 84 and 86 to establish a desired program setting. An operating sequence for programming a cover setting can be provided by first depressing the set button 80, sequentially depressing the upward directional button 88 and the downward directional button 90 to achieve a desired range of movement, and then depressing one of the first 82, second 84, or third 86 setting buttons to store the commands. A display portion 92 may be located in the program memory portion 64 for displaying the position of the cover member 30 according to the program setting buttons to assist the user in determining the best settings. The display of the cover member may also be incorporated into the conventional display portion 60 to save on space in the key entry means 44 and the face of the key entry 44 can be reconfigured as desired to accommodate such a change.

A desired cover member program setting is inputted into the microprocessor 56 through a line 94 extending from the key entry 44 therebetween and the microprocessor proceeds to store the setting in the program memory 58 by inputting the appropriate signal through a line 96 which extends between the microprocessor and program memory 58. Upon the appropriate memory command being entered into the key entry 44, such as by depressing one of the setting buttons 82, 84 or 86, the desired program command is signalled to the microprocessor 56 through line 94. The microprocessor 56 then queries the program memory 58 on line 96 and the program memory responds by issuing the appropriate command cycle to the microprocessor through a line 98 which extends therebetween and in parallel to the line 96. Alternatively, the microprocessor 56 is directly caused to issue the appropriate commands to the electric motor 38 to selectively elevate and lower the cover member 30 by simply depressing either the upward directional button 88 or the downward directional button 90.

The microprocessor 56 causes the electric motor 38 to activate and raise the cover member 30 in a first upward direction through a first activation signal issued on line 100. The cover member 30 is reversibly lowered in a second downward direction through a second activation signal issued by the microprocessor 56 on line 102. The motor 38 is of a conventional AC or DC type and preferably includes a rotating gear head member 104 upon which is wound a length of the cord 34 corresponding to the second end 38.

The signals issued by microprocessor 56 cause the motor 38 to wind or unwind a desired length of the cord 34 to operate for a given time frame the motor to rotate the gear head 104, by causing the gear head to rotate in either a clockwise or counterclockwise direction in order to elevate or lower the cover member 30 the desired distance. The steps of lowering and elevating the cover member 30 are, according to a preferred embodiment, preset into the microprocessor 56 to correspond with the heating cycle of the oven such that the depressing of the cook 66 button on the key entry 44 causes the motor 38 to lower the cover member 30 to the lowered position 48 shown in FIG. 1 and the termination of the heat or defrost cycle conversely causes the motor 38 to retract the cover member upwardly to the elevated position 46 also shown in FIG. 1.

According to a further preferred embodiment, the command to raise the cover member 30 may also be provided by depressing the button or lever 68 on the key entry 44 which causes a command to be issued to the microprocessor 56 via a line 106 connecting the microprocessor 56 to the open door button 68 concurrently with opening the microwave door 24. The cover 30 is again lowered by depressing the cook button 66 as previously described.

Referring again to FIG. 2, an alternative elevating and lowering structure according to yet a further preferred embodiment 107 is disclosed for elevating and lowering the cover mechanism without the need for any of the functions of the previously described key entry 44 or program memory 58. A pulley assembly 108 is provided for supporting the cord 34 leading to the cover member 30. The pulley assembly 108 includes a rotating pulley member 110 which is mounted to a pivoting lever 112 through a rotating axis 114 so that the cord 34 passes over the rotating pulley 110. The lever 112 is likewise pivotally mounted to a portion of the microwave body 12 through a further axis 116 and is pivotal in either a first generally downward direction as illustrated by arrow 118 and a second generally upward direction as illustrated by arrow 120.

A door switch 122 is incorporated into the microwave door latch mechanism and serves as the primary mechanism for actuating the elevating and lowering structure 107. Upon closing the door 24, the switch 122 causes the microprocessor to issue a signal on line 102 to cause the gear head to rotate to unwind the cord 34 and attached cover 30. The downward motion of the cover 30 may also be triggered by depressing the cook button 66. The cover member 30 accordingly descends downwardly within the microwave interior until contacting the food item or the bottom of the microwave. At that point, continued unwinding of the cord 34 causes a slackened tension between the cover member 30 and the pulley assembly 108 which results in the lever member 112 rotating upwardly along the arrow 120 due to a spring member 126 which biases upwardly the lever member 112 from the microwave interior. While not shown in the control schematic of FIG. 2, a bracket can be mounted to extend from the microwave ceiling and secures the upwardly biasing spring 126 relative to the lever 112.

A switch 128 is positioned on an underside of the lever 112 and responds to the upward pivoting of the lever 112 by issuing a disconnect signal to the microprocessor 56 on a line 131. Connecting the switch 128 to the microprocessor 56. In order to position the cover 30 at a desired point just above the food item, the microprocessor 56 may also be programmed to supply a signal to the gear motor 38 to cause the gear motor to rotate in a reverse fashion for a given short time frame, such as 0.1 seconds, to rewind a small length of the cord 34 and to reposition the cover in a desired position above the point of contact with the object initiating stop.

Once the desired microwave function is completed, the motor 38 can be commanded to wind the cord 34 and elevate the cover member 30 by either opening the door 24 so as to trip the door switch 122 or by depressing the upward button 88 on the key entry 44. The cover 30 elevates upwardly until it trips a limit switch 130 attached to the top surface 14 of the microwave interior. The upward movement of the cover member 30 causes it to depress a switch member 132 and the limit switch 130 then issues a disconnect signal to the microprocessor 56 along a line 134 which extends therebetween.

Figure 3:
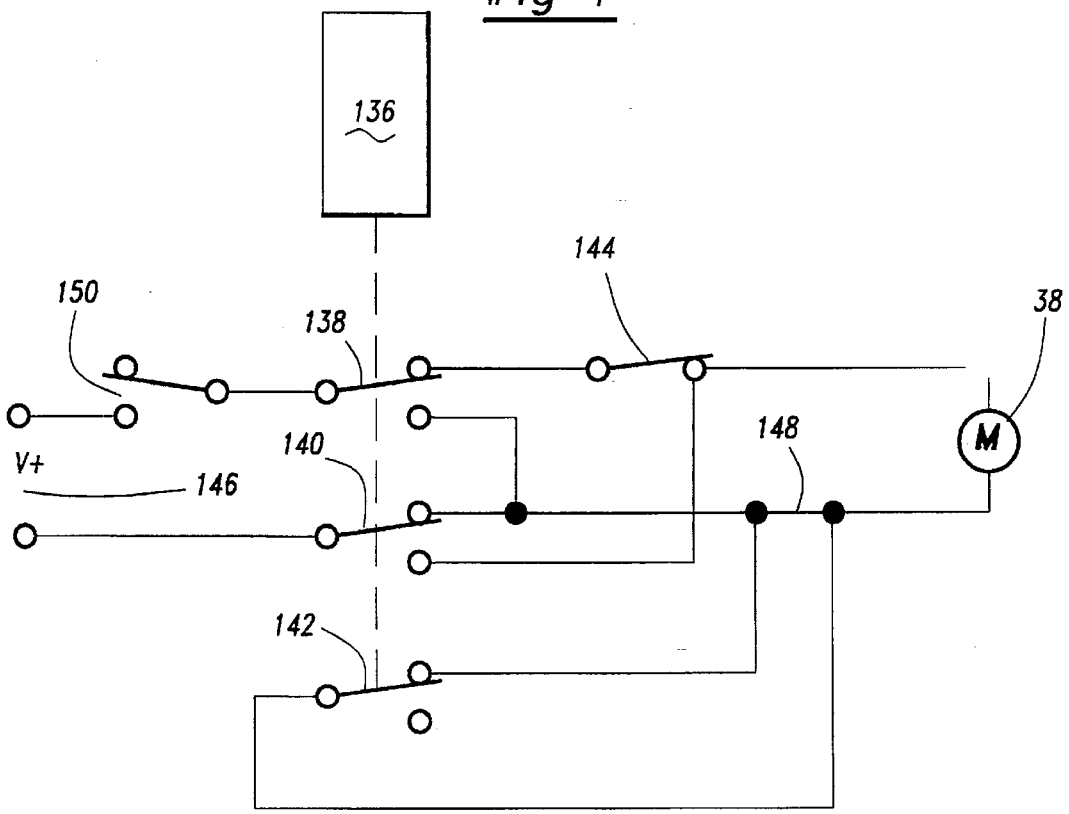
FIG. 3 is a schematic of the switch positions of the microwave oven and covering device according to a preferred embodiment at the beginning of a heating cycle.
Figure 4:
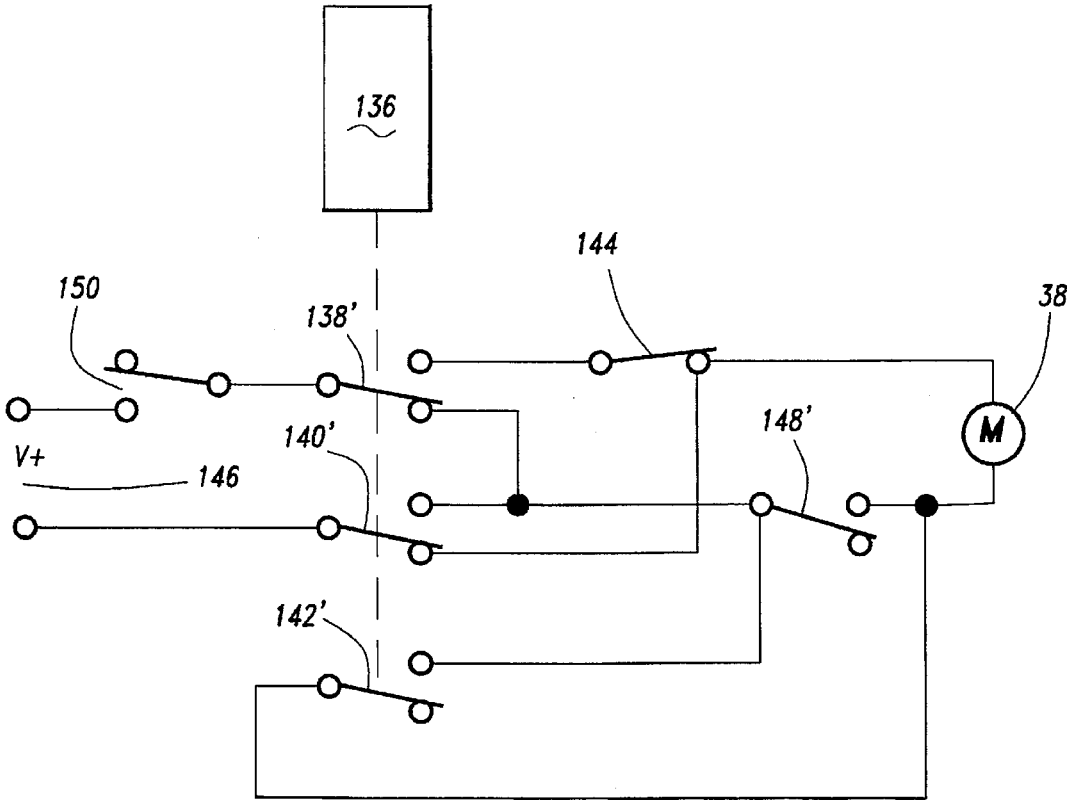
FIG. 4 is a schematic similar to that shown in FIG. 3 of the switch positions according to the preferred embodiment at the end of the heating cycle.

Referring now to FIGS. 3 and 4, the switch positions of the mechanism 107 for elevating and lowering the microwave cover are shown both prior to and at the end of the heating cycle. Referring to FIG. 3, a relay 136 is energized by the microwave control panel during the heating stage and causes a first relay contact 138, a second relay contact 140, and a third relay contact 142 all to be energized to first positions as illustrated. The first relay contact 138 according to FIG. 3 communicates a front panel enable/disable switch 150 with a tension sensing switch, identified as relay 144 and illustrated in FIG. 2 as switch 128. The switch 144 is thus enabled to terminate the downward motion of the cover 30 and to reset it to the proper position above the microwave bottom. The relay 140 connects the voltage supply, illustrated at 146, with the electric motor 38 to effect lowering of the cover 30 and the relay 142 closes a circuit with a relay 148 which represents the top of oven limit switch 130. The relay 148 enables the switch 130 in contemplation of rewinding of the cover member 30.

The relay and switch contacts shown in FIG. 3 remain in their described positions until the heating cycle ends or the microwave door is opened. Referring then to FIG. 4, the positions of the relays and switches upon completion of the heating cycle are reversed. The relay 136 is deenergized at the end of the cycle and in turn causes relays 138, 140 and 142 to reverse to positions 138', 140' and 142'. As a result, the relay contacts effectively reverse power to the motor 38 causing it to rotate in a reverse direction to lift the cover 30 upwardly. The top of oven limit switch is shown in a reversed position 148' upon being tripped by the upwardly elevating cover member 30 and having signalled the microprocessor to disconnect the motor 38.

As is readily apparent from the above disclosure, the elevating and lowering features provided by the lever assembly 108, the door switch 122, and the limit switch 130 can be incorporated along with the features shown in the key entry 44 and program memory 58 into the microwave device. In a preferred embodiment, the lever assembly 108 is utilized to prevent the program entry means from lowering the cover member 30 beyond what is required and the limit switch 130 from likewise elevating the cover member beyond its uppermost position.

Having described my invention, additional embodiments will become apparent to those skilled in the art to which it pertains. Specifically, the suspending means disclosed can be replaced by a lever mechanism which would replace the length of cord for raising and lowering the cover 30. Other variations of electrical schematics may also be provided for elevating and lowering the cover member, the above disclosed being only the preferred embodiment.

I claim:

1. A microwave oven with a built-in food covering mechanism, the microwave oven having a body with an open interior defined by a top, a bottom and at least one side, a door hingedly attaching to the body and being selectively opened and closed to reveal the open interior, said food coveting mechanism comprising:

a covering member having a body portion and a downwardly extending side portion extending around a circumference of said body portion;

suspending means attaching to said covering member and suspending said covering member within the microwave oven interior;

actuation means for elevating and for lowering said covering member to and from desired positions between the top and the bottom of the microwave oven interior, said actuation means including:

an electric motor operably connected to said covering member through said suspending means;

microprocessor means communicating with said electric motor and operable to selectively activate and deactivate said motor; and said covering member being actuable to a first lowered position wherein said body portion and downwardly extending side portion covers an item placed upon the bottom of the microwave oven interior prior to and during heating, said covering member being subsequently actuable to a second elevated and retracted position proximate to the top of the microwave oven interior subsequent to said heating to permit entry and removal of the item.

2. The microwave oven with built-in food covering mechanism according to claim 1, further comprising a key entry means communicating with said microprocessor means and instructing activation and deactivation of said covering member.

3. The microwave oven with built-in food covering mechanism according to claim 2, said actuation means further comprising a program memory means in communication with said microprocessor means and said key entry means, said program memory means issuing at least one presettable operating parameter to said microprocessor means for relay to said motor means upon request by said key entry means.

4. The microwave oven with built-in food covering mechanism according to claim 3, said key entry means further comprising a program sentry portion capable of inputting settings into said program memory means, said program entry portion including a plurality individual memory settings and upward and downward manual actuating buttons.

5. The microwave oven with built-in food covering mechanism according to claim 1, said suspending means further comprising a length of cord, a first end of said cord attaching to said electric motor means, an intermediate portion of said cord being engaged by a support positioned in the microwave oven top for slidably receiving said cord, and a second end of said cord attaching to said suspended covering member.

6. The microwave oven with built-in food covering mechanism according to claim 5, said support further comprising a rotatably mounted pulley.

7. The microwave oven with built-in food covering mechanism according to claim 6, said rotatable pulley being incorporated into a pivoting lever assembly, said lever assembly comprising:

a lever member which is pivotally mounted relative to a surface of the oven interior, said lever member being pivotally biased in a downward direction responsive to the weight of said covering member;

a spring member secured to the oven interior and upwardly biasing said lever member in an opposite and upward directions in response to a relaxation in tension in said cord which is indicative of said covering member contacting the bottom of the microwave interior; and a disconnect switch electrically communicating with said microprocessor means and instructing said microprocessor means to shut off said motor means upon said covering member reaching the microwave bottom.

8. The microwave oven with built-in food covering mechanism according to claim 5, further comprising a limit switch secured to the top of the microwave oven interior and being responsive to the covering member elevating upwardly to instruct said microprocessor means to shut off said motor means when said covering member reaches the top of the microwave oven interior.

9. The microwave oven with built-in food covering mechanism according to claim 1, further comprising a door switch operably connected to the door and instructing said microprocessor means to raise said covering member upon the door being opened.

10. The microwave oven with built-in food covering mechanism according to claim 9, said door switch instructing said microprocessor means to lower said covering member upon the door being closed.

11. A microwave oven with a built-in food covering mechanism, the microwave oven having a body with an open interior defined by a top, a bottom and at least one side, a door hingedly attaching to the body and being selectively opened and closed to reveal the open interior, said food covering mechanism comprising:

a covering member;

suspending means attaching to said covering member and suspending said covering member within the microwave oven interior;

actuation means for elevating and for lowering said covering member to and from desired positions between the top and the bottom of the microwave oven interior, said actuation means including:

an electric motor operably connected to said covering member through said suspending means, said suspending means further including a length of cord, a first end of said cord attaching to said electric motor, an intermediate portion of said cord being engaged by a support positioned in the microwave oven top for slidably receiving said cord, a second end of said cord attaching to said suspended covering member, said electric motor further comprising an AC/DC electric motor with a rotating gear head, said gear head selectively winding and unwinding said cord to elevate and lower said covering member;

microprocessor means communicating with said electric motor and operable to selectively activate and deactivate said motor; and said covering member being actuable to a first lowered position to cover an item placed upon the bottom of the microwave oven interior prior to and during heating, said covering member being subsequently actuable to a second elevated and retracted position subsequent to said heating to permit entry and removal of the item.

* * * * *

UNITED STATES PATENT AND TRADEMARK OFFICE

CERTIFICATE OF CORRECTION

PATENT NO. : 5,660,755

DATED : August 26, 1997

INVENTOR(S) : Mitchell W. Michaluk III

It is certified that error appears in the above-identified patent and that said Letters Patent is hereby corrected as shown below:

Column 3, line 60, delete "4" and insert --44--.

Column 7, line 40, delete "sentry" and insert--entry--.

Signed and Sealed this

Twenty-first Day of July, 1998

Bruce Lehman

*Attest:*

BRUCE LEHMAN

*Attesting Officer*

*Commissioner of Patents and Trademarks*